US005398466A

United States Patent [19]

Oyama et al.

[11] Patent Number: 5,398,466

[45] Date of Patent: Mar. 21, 1995

[54] STANCHION UNIT ASSEMBLY FOR FLOOR BOARDS

[75] Inventors: Fumihiro Oyama; Koji Marui, both of Osaka; Yoshinari Kawai, Higashi, all of Japan

[73] Assignee: Sumitomo Rubber Industries, Ltd., Japan

[21] Appl. No.: 118,718

[22] Filed: Sep. 10, 1993

Related U.S. Application Data

[62] Division of Ser. No. 791,239, Nov. 13, 1991, Pat. No. 5,301,480.

[30] Foreign Application Priority Data

Nov. 19, 1990 [JP] Japan ..... 2-121166
Nov. 19, 1990 [JP] Japan ..... 2-313198
Nov. 30, 1990 [JP] Japan ..... 2-334648

[51] Int. Cl.[6] ..... E04B 5/43
[52] U.S. Cl. ..... 52/126.6; 52/263
[58] Field of Search ..... 52/126.6, 263, 654.1

[56] References Cited

U.S. PATENT DOCUMENTS 3,279,134 10/1966 Donovan ..... 52/126.6
3,470,663 10/1969 Tate ..... 52/263
3,811,237 5/1974 Bettinger ..... 52/263 X
4,050,257 9/1977 Parks ..... 52/263 X
4,068,442 1/1978 Troutner ..... 52/650.2 X
4,074,474 2/1978 Cristy ..... 52/126.6 X
4,201,023 5/1980 Jungbluth ..... 52/654.1 X
4,214,410 7/1980 Mitsueda ..... 52/DIG. 11 X
4,348,843 9/1982 Cairns ..... 52/799 X
4,417,426 11/1983 Meng ..... 52/299 X
4,596,581 10/1985 Gustafson ..... 52/126.6 X
4,821,480 4/1989 Silvey ..... 52/650.2 X
5,048,242 9/1991 Cline ..... 52/126.6
5,052,156 10/1991 Tanaka ..... 52/126.6

*Primary Examiner*—Carl D. Friedman
*Assistant Examiner*—Beth A. Aubrey
*Attorney, Agent, or Firm*—Stevens, Davis, Miller & Mosher

[57] ABSTRACT

A stanchion unit assembly for supporting floor boards comprising: a plurality of vertical stanchion units including rests which constitute the upper portions of the vertical stanchion units and support the floor boards, and base plates which constitutes the lower portions of the vertical stanchion units and are disposed in contact with a floor foundation; a plurality of oblique member support stanchion units including rests which constitute the upper portions of the oblique member support stanchion units and support the floor boards, and base plates which constitute the lower portions of the oblique member support stanchion units and are provided with oblique member support parts; a plurality of floating rests supporting the floor boards on the tops of the floating rests and provided with oblique member support parts at the lower portions of the floating rests; and a plurality of oblique members extending from the oblique member support parts of each of the oblique member support stanchion units to those of the floating rests located around the oblique member support stanchion unit diagonally thereto.

2 Claims, 5 Drawing Sheets

STANCHION UNIT ASSEMBLY FOR FLOOR BOARDS

This is a Divisional of application Ser. No. 07/791,239, filed Nov. 13, 1991, now U.S. Pat. No. 5,301,480, granted on Apr. 12, 1994.

BACKGROUND OF THE INVENTION

1. Field of the Invention

The present invention relates to a stanchion unit for supporting floor boards laid at a prescribed distance from a floor slab, and more particularly relates to a stanchion unit assembly made of a plurality of stanchion units coupled together so that the assembly has a good rigidity to firmly support floor boards.

2. Description of the Prior Art

A factory, an office or the like, in which various electric or electronic machines are operated, needs to be provided with a large number of power supplies for the machines. The section of the factory, the office or the like, in which a computer is operated, needs to be provided with cables for connecting the computer to various terminal machines for input to and output from the computer. Conventionally, power outlets for the power supplies are provided in walls or the like. If a connection cord is laid on a floor so as to extend from such a power outlet to such a machine or computer, the cord will be likely to be accidentally pulled out from the outlet by the foot of a person walking on the floor, or to be accidentally cut off by another machine placed on the cord, or by a truck or the like during the passing thereof across the cord. If such an accident happens, data being entered into or sent out from the computer is likely to be destroyed. To prevent such accident from happening, the floor is made of a double structure to lay the connection cord between the upper and lower portions of the floor and a power outlet or a cable connector is exposed on the floor near the machine or computer. As shown in FIG. 1, the lower portion of the floor is made of a floor slab 02. The upper portion of the floor is made of a plurality of floor boards 01, each of which is quadrangularly shaped and has a length of 30 to 60 cm for each side edge of the board and a thickness of 20 to 50 mm. The floor includes a plurality of stanchions 03 set up on the floor slab 02 and disposed at intervals, each of which corresponds to the length of the side edge of the floor board. Each of the stanchions supports four mutually adjacent floor boards at the corners thereof and the upper ends of the stanchions whose lower ends are secured to the floor slab by an adhesive. To reinforce the adhesive-secured stanchions against an earthquake or the like, as shown in FIG. 2 beams 04 are secured at both the ends thereof to the mutually adjacent stanchions at the upper, middle or lower portions thereof. In addition, in order to reinforce the adhesive-secured lower ends against an earthquake or the like, as shown in FIG. 3 both end portions of an oblique strut 05 are secured to each mutually adjacent stanchions and the intermediate portion of the strut 05 is secured to the floor slab by bolts.

3. Problems to be Solved by the Invention

However, the beams need to be detached before the laying of a cable in the floor and attached again after the laying. The attachment and detachment takes time and trouble so as to deteriorate work efficiency. This is a problem. Besides, providing the oblique struts makes it necessary to provide the floor slab with holes for the bolts, renders the open space between the floor board and the floor slab narrower, and takes time and trouble so as to deteriorate work efficiency. This is also a problem.

Further, in the conventional structure, if the top of the floor slab, on which the stanchions are set up, are not flat, the stanchions differ from each other in the height of the top thereof so that the floor boards cannot be flatly laid on them. A conventional way of solving this problem is to attach such a rest to such a stanchion so that the rest can be vertically moved to modulate the height of the rest. However, if such a base plate to which the stanchion is secured is placed on the non-flat portion of the floor slab, the stanchion is inclined so that the bottoms of the floor boards are not in surface contact with the top of the rest at the corners of the boards, and the boards are unstably supported.

To avoid such unstable supporting, the non-flat portion of the floor slab is cut to be flat, or the thickness of the layer of an adhesive for securing the base plate to the floor slab is modulated to make the rest horizontal. However, cutting the non-flat portion of the floor slab to make the portion flat takes much time and trouble, and the thickness of the layer of the adhesive is likely to alter due to a secular change such as drying, to result in inclining the floor boards after a long period. These are problems. Besides, a shim is sometimes provided in between the top of the rest and the bottom of the floor board at the corner thereof to avoid the unstable supporting, but a squeak is likely to occur in between the shim and the floor board or the rest under a walking foot in the long-period use of the stanchion and the floor board. This is also a problem. As a result, a way of avoiding unstable supporting is most widely adopted nowadays. Bolts are inserted into such a base plate at the four corners thereof, and the length of the projection of each of the bolts from the base plate is modulated to make the base plate horizontal. However, modulating the length of the projection of each of the four bolts takes much time and trouble. This is also a problem.

SUMMARY OF THE INVENTION

It is an object of the present invention to provide a stanchion unit assembly which supports floor boards and in which different types of stanchion units are coupled together so that the assembly has good rigidity, and the open space under the floor boards is large.

It is another object of the present invention to provide a stanchion unit which supports floor boards and can be firmly coupled to other stanchion units through a simple construction to securely keep the stanchion units in check without fastening them to a foundation such as a floor slab with bolts.

Accordingly, it is still another object of the present invention to provide a rest assembly which is for a stanchion unit for supporting floor boards and by which not only the inclination of the floor boards, which results from placing the stanchion unit on the unflat portion of a floor slab, but also the height of the boards can be modulated.

The stanchion unit assembly of a first aspect of the present invention is characterized in that it comprises a plurality of vertical stanchion units, a plurality of oblique member support stanchion units, a plurality of floating rests, and a plurality of oblique members; the vertical stanchion units include rests constituting the upper portions of the units and supporting the floor boards, and base plates constituting the lower portions of the units and disposed in contact with a floor foundation; the oblique member support stanchion units include rests constituting the upper portions of the units and supporting the floor boards, and base plates constituting the lower portions of the units and provided with oblique member support parts; the floating rests support the floor boards on the tops of the floating rests and are provided with oblique member support parts at the lower portions of the floating rests; a number of the vertical stanchion units and all of the oblique member support stanchion units are alternately disposed on first imaginary straight lines extending in the direction of the width or depth of a room provided with the floor boards laid therein, and have intervals, each of which is slightly shorter than each side edge of the floor board; all of the floating rests and the others of the vertical stanchion units are alternately disposed on second imaginary straight lines extending in parallel with the first ones and alternately thereto and separated therefrom by a distance slightly shorter than each side edge of the floor board, so that the floating rests face the number of the vertical stanchion units in the direction of the depth or width of the room, and the others of the vertical stanchion units face the oblique member support stanchion units in the direction of the depth or width of the room; and the oblique members extend from the oblique member support parts of each of the oblique member support stanchion units to those of the floating rests located around the oblique member support stanchion unit diagonally thereto.

The stanchion unit of a second aspect of the present invention is characterized by including a rest on which the floor boards are supported; a pole fastened at the upper end thereof to the rest; and a plurality of substantially horizontal bars secured at prescribed intervals to the peripheral surface of the pole at the lower end thereof and one end of each of the bars and coupled at the other ends thereof to those of the bars of the other stanchion units adjacent to the former.

L-shaped plates bent substantially rectangularly may be provided on the substantially horizontal bars at the latter ends thereof in such a manner that one portion of each of the plates is coupled to that of the corresponding substantially-horizontal bar of the other adjacent stanchion unit.

The rest assembly of a third aspect of the present invention is characterized by comprising a base having a concave reception part as the central portion of the top of the base, and a first hole vertically extending through the base at the center of the concave reception part; a lower cylinder open at the top thereof, and having a convex bottom in surface contact with the concave reception part, and a second hole vertically extending through the convex bottom at the center thereof and larger in diameter than the first hole; a first clamping member which has an outside diameter nearly equal to the diameter of the first hole, and is inserted in the first and the second holes from the first hole to the second hole so as to clamp the base and the lower cylinder to each other; an upper cylinder fitted in the open top of the lower cylinder, and supporting the floor boards at the corners thereof on the top of the upper cylinder; and a second clamping member which vertically extends through the upper cylinder at the center of the top thereof, and is located in contact with the upper end of the first clamping member at the lower end of the second clamping member, and capable of being turned to move the upper cylinder up or down.

The rest assembly may include a jut provided on the peripheral surface of the lower cylinder, and substantially horizontally extending from the surface; and inclination fixing screws inserted at substantially equal intervals into the jut, and located in contact with the top of the base at the lower ends of the screws.

If the stanchion unit having the rest assembly provided in accordance with the present invention is inclined when being set up on the floor slab, the upper cylinder is removed and the first clamping member is loosened so that the lower cylinder can be swung within the clearance between the cylinder and the first clamping member in the second hole of the cylinder about the bolt. The lower cylinder is then appropriately swung to make the open top thereof horizontal. The first clamping member is thereafter tightened to firmly fix the lower portion of the lower cylinder to the concave reception part of the base. The upper cylinder is then fitted again in the lower cylinder. The inclination of the stanchion unit can thus be modulated. If the height of the top of the upper cylinder differs from that of the top of the upper cylinder of the rest assembly of another stanchion unit, the former height can be modulated to the latter by turning the second clamping member to move the upper cylinder up or down.

If the rest assembly includes the jut on the peripheral surface of the lower cylinder and the inclination fixing screws inserted at the substantially equal intervals in the jut and located in contact with the top of the base at the lower ends of the screws, the assembly can be firmly kept at a desired angle of inclination by the screws.

DETAILED DESCRIPTION OF THE EMBODIMENT

Figure 1:
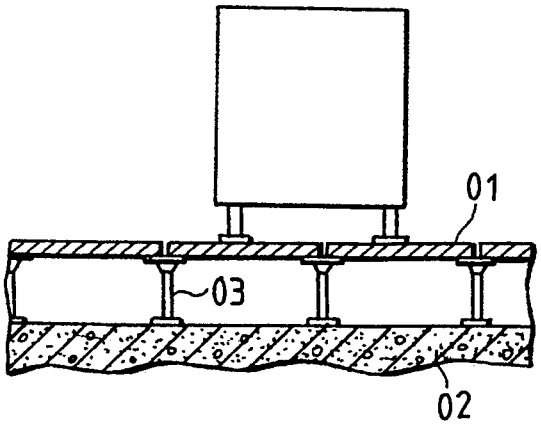
FIG. 1 PRIOR ART
FIG. 1 is a front view of a part of a conventional stanchion unit assembly in which a plurality of stanchions set up on the floor slab.
Figure 2:
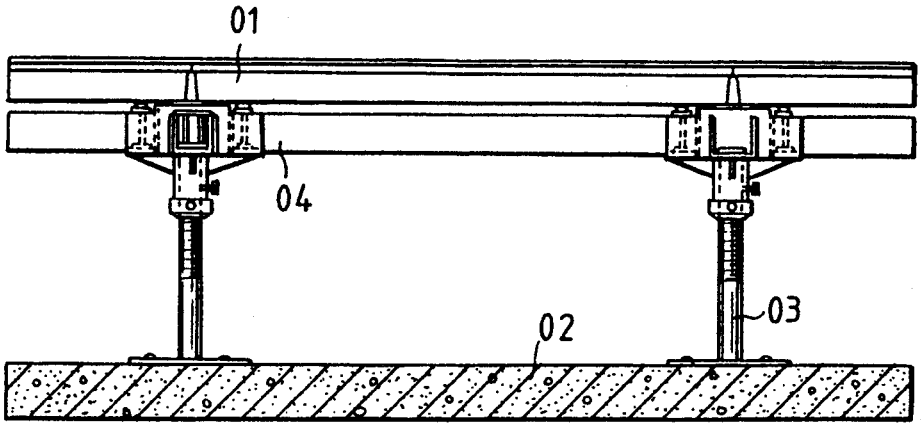
FIG. 2 PRIOR ART
FIG. 2 is a front view of a part of a conventional stanchion unit assembly in which beams are secured at both the ends thereof to the mutually adjacent stanchions.
Figure 3:
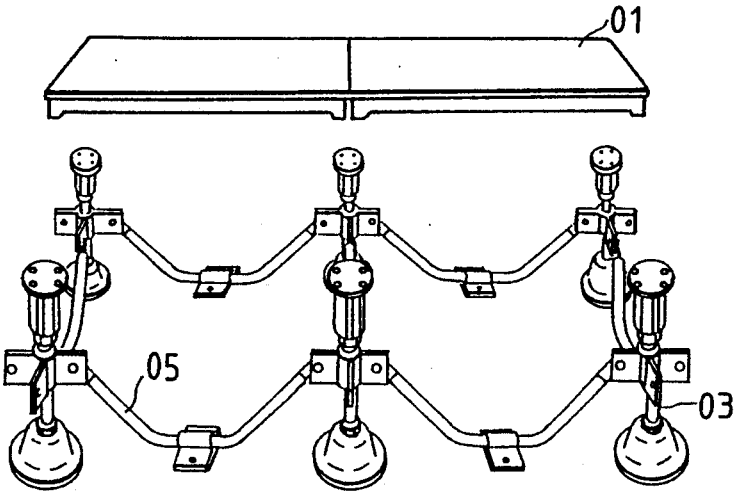
FIG. 3 PRIOR ART
FIG. 3 is a front view of a part of a conventional stanchion unit assembly in which oblique struts are used.

Embodiments of the present invention are hereafter described with reference to the drawings attached hereto.

FIGS. 4, 5, 6 and 7 show a stanchion unit assembly which is the first embodiment and supports floor boards 1. The assembly comprises a plurality of vertical stanchion units 2 having rests 6 constituting the upper portions of the units and supporting the floor boards 1, a plurality of oblique member support stanchion units 3 which have rests 6 similar to those of the vertical stanchion units and constituting the upper portions of the oblique member support stanchion units and have base plates 13 constituting the lower portions of the oblique member support stanchion units and provided with oblique member support parts, a plurality of floating rests 4 supporting the floor boards on the tops of the floating rests and provided with oblique member support parts at the lower portions of the floating rests, and oblique members 9.

Figure 6:
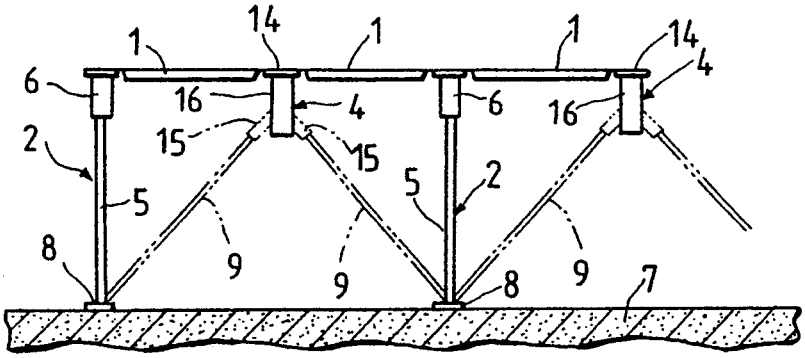
FIG. 6 is a sectional view of a portion of the part along a line III shown in FIG. 4.

Each of the vertical stanchion units 2 includes a vertical pipe 5, the rest 6 which is fastened to the pipe at the upper end thereof so as to be capable of being vertically moved to modulate the height of the rest and supports the four mutually adjacent floor boards 1 an the corners thereof on the top of the rest, and a base plate 8 which has its bottom on a floor foundation 7 such as a floor slab and to which the vertical pipe is secured at the lower end thereof and the central portion of the top of the base plate so as to be supported by the base plate, as shown in FIG. 6.

Figure 5:
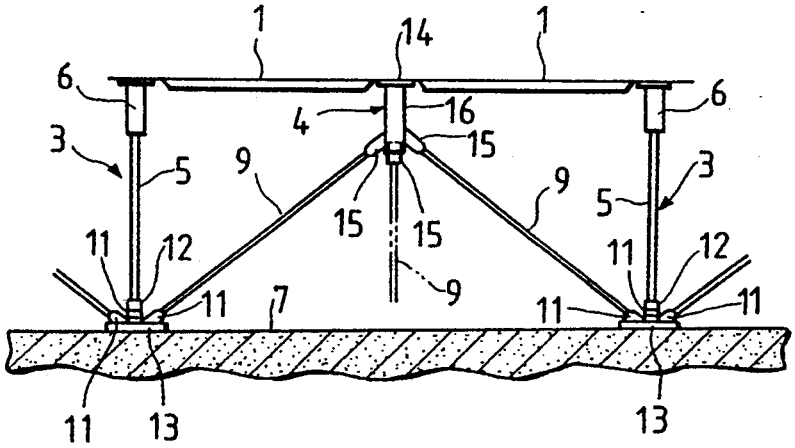
FIG. 5 is a sectional view of a portion of the part along a line 5—5 shown in FIG. 4.
Figure 7:
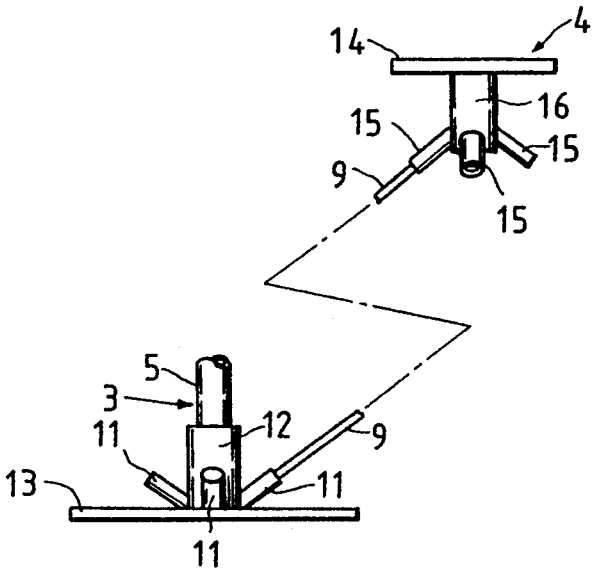
FIG. 7 is a side view of a portion of the part to illustrate the upper and lower oblique member support means of the assembly.

Each of the oblique member support stanchion units 3 includes a vertical pipe 5, the rest 6, a vertical pipe support cylinder 12, to the peripheral surface of which four oblique member support tubes 11, in which the oblique members 9 are fitted at the lower ends thereof, are secured at substantially equal intervals, and the base plate 13 which has its bottom on the floor foundation 7 and to which the cylinder is secured at the top of the base plate and set up thereon, as shown in FIGS. 5 and 7.

Each of the floating rests 4 includes a plate 14 for supporting the four mutually adjacent floor boards 1 at the corners thereof on the top of the plate, and a support cylinder 16 which is fastened to the bottom of the plate at the central portion thereof so as to extend substantially vertically and to which four oblique member support tubes 15, in which the oblique members 9 are fitted at the upper ends thereof, are secured at substantially equal intervals on the peripheral surface of the cylinder, as shown in FIGS. 5 and 7.

Each of the floor boards 1 is made of two metal sheets coupled to each other at the edges thereof so that the board has an interior opening. Instead of that, each of the floor boards may be made of a material such as concrete, fiberglass-reinforced concrete and calcium silicate, and a reinforcing material such as a steel sheet, which is provided on the bottom of the former material.

Figure 4:
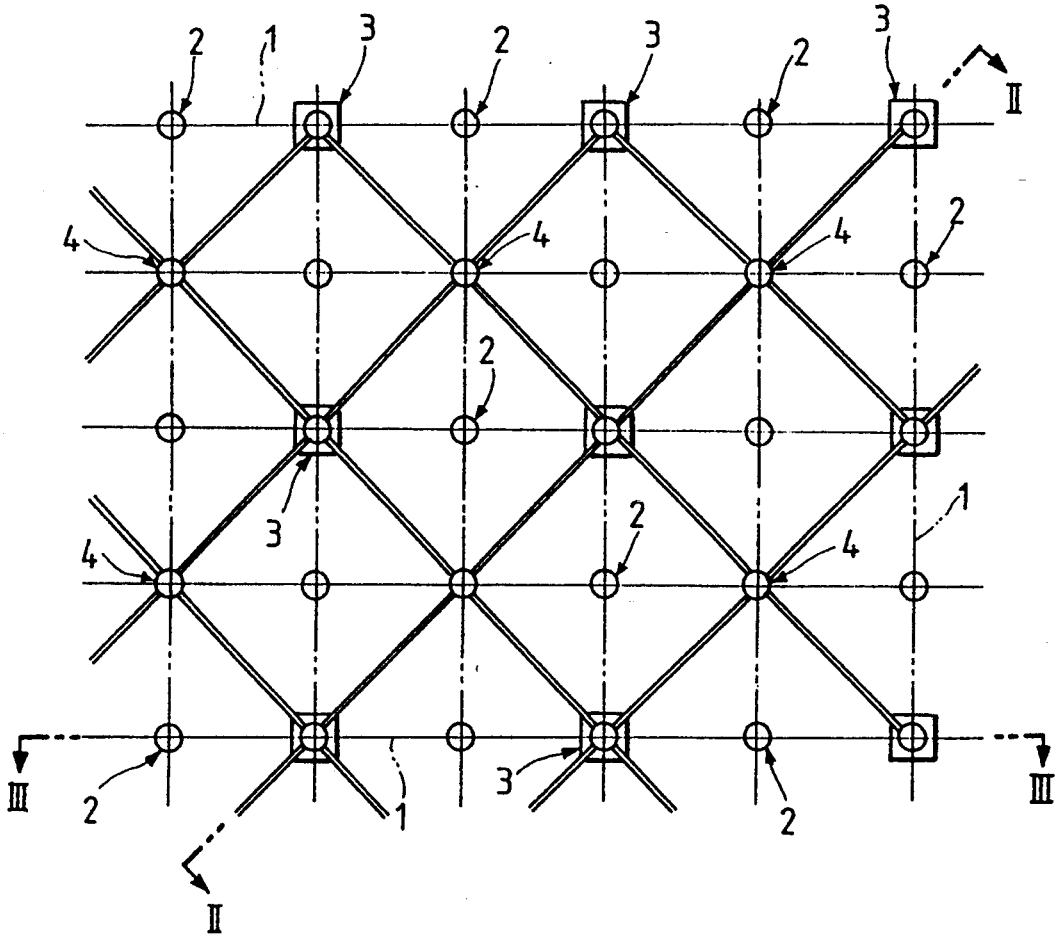
FIG. 4 is a plan view of a part of a stanchion unit assembly which is an embodiment of the present invention and supports floor boards not shown in FIG. 4.

FIG. 4 is a plan view of a part of the stanchion unit assembly. The left-to-right direction of FIG. 4 denotes the direction of the width of a room in which the assembly and the floor boards 1 are provided. The top-to-bottom direction of FIG. 4 denotes the direction of the depth of the room. The floor board 1 shown at the left upper corner of FIG. 4 is supported by the vertical stanchion units 2 located at the left upper corner and right lower corner of the floor board with regard to FIG. 4, and is also supported by the oblique member support stanchion unit 3 located at the right upper corner of the board with regard to FIG. 4 in such a manner that the distance between the oblique member support stanchion 3 and each of the vertical stanchion units is slightly shorter than each side edge of the board. The floor board 1 is also supported by the floating rest 4 located at the left lower corner of the board with regard to FIG. 4. The other floor board 1 located at the right of the former floor board with regard to FIG. 1 is supported at the left upper corner of the latter by the oblique member support stanchion unit 3, at the left lower corner of the latter by one of the vertical stanchion units 2, at the right upper corner of the latter by the yet other vertical stanchion unit 2, and at the right lower corner of the latter by the other floating rest 4.

The vertical stanchion units 2 and the oblique member support stanchion units 3 are alternately disposed on a first imaginary straight line extending in the direction of the width of the room. The floating rests 4 and the other vertical stanchion units 2 are alternately disposed on a second imaginary straight line extending in parallel with the first one and separated therefrom in the direction of the depth of the room by a distance slightly shorter than each side edge of the floor board 1. The floating rests 4 face the vertical stanchion units 2 on the first imaginary straight line in the direction of the depth of the room. The other vertical stanchion units 2 face the oblique member support stanchion units 3 in the direction of the depth of the room. The yet other vertical stanchion units 2 and the other oblique member support stanchion units 3 are alternately disposed on a third imaginary straight line extending in parallel with the first and the second ones and separated from the second one in the direction of the depth of the room by a distance equal to the former. The other floating rests 4 and the still yet other vertical stanchion units 2 are alternately disposed on a fourth imaginary straight line extending in parallel with the former ones and separated from the third one in the direction of the depth of the room by a distance equal to the former. Rows of a number of the vertical stanchion units 2 and all of the oblique member support stanchion units 3, and rows of all of the floating rests 4 and the others of the vertical stanchion units 2 are thus alternately disposed.

The four oblique members 9 are inserted into the oblique member support tubes 11 of each oblique member support stanchion unit 3 and the oblique member support tubes 15 of the floating rests 4 located around the unit diagonally thereto. The floating rests 4 are supported by the four oblique members 9 in such a manner that the rest float over the floor foundation 7. Each floor board 1 is supported at the four corners thereof by the two vertical stanchion units 2, the one oblique member support stanchion unit 3 and the one floating rest 4.

All the oblique member support stanchion units 3 of the stanchion unit assembly and all the floating rests 4 thereof are coupled together by all the oblique members 9 thereof so that the assembly has a good rigidity and is strong enough to withstand a jolt such as an earthquake. Since each floating rest 4 is supported by the four oblique members 9, the rest does not sink but securely support the floor boards 1 at the corners thereof even if the rest is locally loaded. Since only one oblique member 9 is provided for each floor board 1 along the diagonal thereof, all the oblique members can be less expensively provided. Since each oblique member 9 only extends obliquely to the directions of the width, depth and height of the room, the open space under the floor boards 1 can be made large enough to prevent the oblique members from hindering work such as wiring under the floor boards.

Although the oblique member support stanchion units 3 and the floating rests 4 are provided with the oblique member support tubes 11 and 15 in which the oblique members 9 are fitted at both the ends thereof, in the embodiment, the present invention is not confined thereto but otherwise embodied so that the four oblique members 9 are secured at equal intervals to the vertical pipe 5 of each oblique member support stanchion unit 3 at one end of each of the oblique members by welding or the like so as not to provide the oblique member support tubes 11 on the pipe, or are secured at equal intervals to the support cylinder 16 of each floating rest 4 at one end of each of the oblique members by welding or the like so as not to provide the oblique member support tubes 15 on the cylinder.

In a stanchion unit assembly provided in accordance with the present invention so as to support floor boards, vertical stanchion units and oblique member support stanchion units are alternately disposed on each of first imaginary straight lines extending in the direction of the width or depth of a room provided with the floor boards laid therein, and have intervals, each of which is slightly shorter than each side edge of the floor board, and floating rests and other vertical stanchion units are alternately disposed on each of second imaginary straight lines extending in parallel with the first ones and alternately thereto and separated therefrom by a distance slightly shorter than each side edge of the floor board, so that the floating rests face the vertical stanchion units on the first imaginary straight lines in the direction of the depth or width of the room and the vertical stanchion units on the second imaginary straight lines face the oblique member support stanchion units in the direction of the depth or width of the room. Oblique members extend from the oblique member support portions of each oblique member support stanchion unit to those of the floating rests located around the unit diagonally thereto. All the oblique member support stanchion units of the assembly and all the floating rests thereof are thus coupled together by the oblique members so that the assembly has a good rigidity and is strong enough to withstand a jolt such as an earthquake. Since only one oblique member is provided for each floor board along the diagonal thereof, the oblique members can be less expensively provided. Since the oblique members only extend obliquely to the directions of the width, depth and height of the room, the open space under the floor boards supported over a floor foundation by the assembly can be made large enough.

Figure 8:
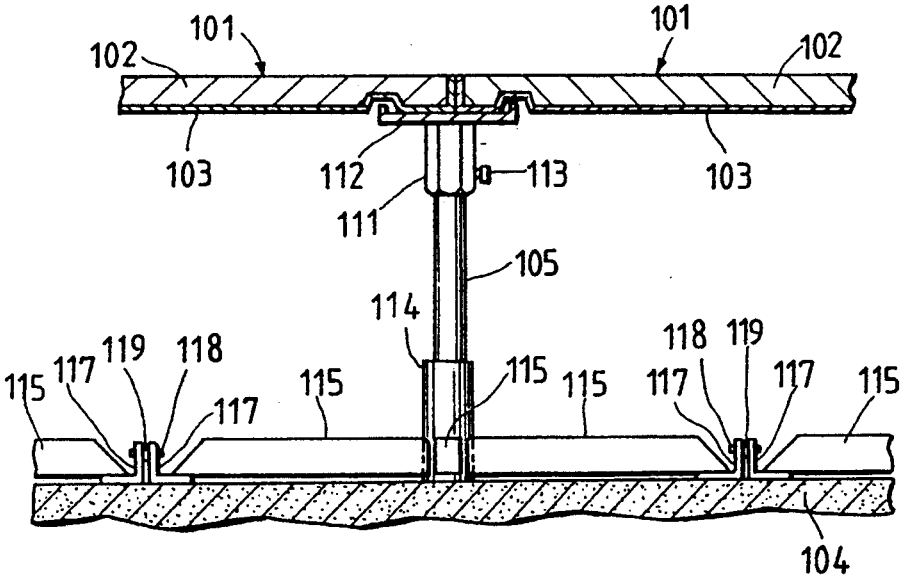
FIG. 8 is a front view of a stanchion unit which is an embodiment of the present invention and is for floor boards.
Figure 9:
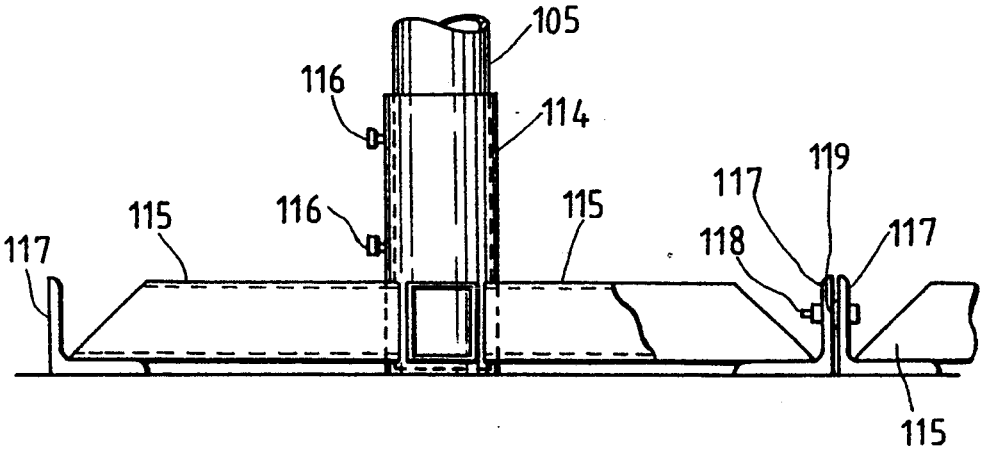
FIG. 9 is a cutaway front view of the unit.
Figure 10:
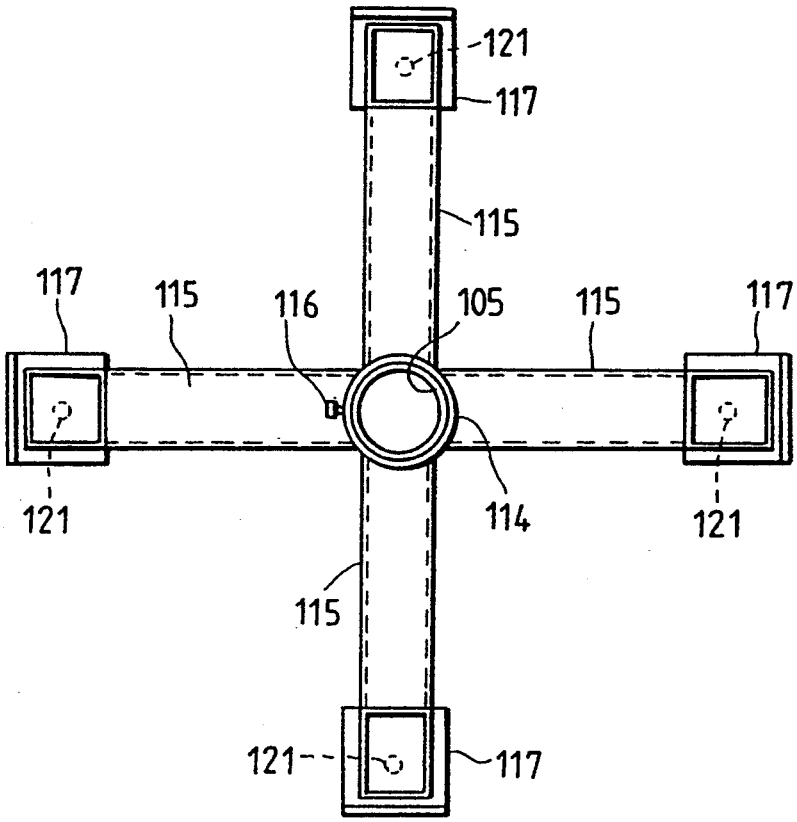
FIG. 10 is a plan view of the unit in the state that it is removed of a rest.

FIGS. 8, 9 and 10 show a stanchion unit which is the embodiment and supports floor boards 101, each of which is quadrangularly shaped and has a length of 30 to 60 cm at each side edge of the board. The floor board 101 includes a body 102 made of fiberglass-reinforced concrete, calcium silicate or the like, and a reinforcing material 103 which is a metal sheet or the like and disposed on the bottom of the body. The floor boards 101 are supported by the stanchion unit on a foundation 104 such as a floor slab and disposed at prescribed intervals. The stanchion unit includes a rest 112, a pole 105, and hollow bars 115.

The rest 112, on which the corners of the floor boards 101 are disposed, is provided on a unit 111 conjoined to the pole 105 at the upper end thereof so that the height of the rest can be modulated. The nut 111 is fitted on the pole 105 so that the nut can be moved up and down, and be fixed in position by tightening a securing screw 113 to the pole and the nut. The size of the rest 112, which is secured to the nut 111 at the upper end thereof, is large enough to dispose the corners of the four mutually adjacent floor boards 101 on the rest. The pole 105 is fitted at the lower end thereof in a cylinder 114 to which the hollow bars 115, each of which has a rectangular cross section, are secured at the lower end of the cylinder by welding or the like at one end of the bar so as to extend substantially horizontally. Screws 116 are driven into the cylinder 114 in the radial direction thereof to secure the pole 105 and the cylinder to each other. The bars 115 are disposed at equiangular intervals of about 90 degrees on the peripheral surface of the cylinder 114, as shown in FIG. 10.

An L-shaped plate 117 is secured at the lower portion thereof to the bottom of each bar 115 at the other end thereof by welding or the like. The upper portion of the plate 117 extends up in front of the latter end of the bar 115. Since the latter end of the bar 115 is located over the foundation 104 by the thickness of the plate 117, the former end of the bar is located on the cylinder 114 over the foundation by the thickness of the plate in order to cause the bar to extend substantially horizontally. A plate equal in thickness to the L-shaped plate 117 and larger in diameter than the cylinder 114 may be secured to the cylinder at the bottom thereof to substantially horizontally support the bar 115 on the former plate at the former end of the bar.

If the length of each side edge of the floor board 101 is 60 cm, the distance from the center of the cylinder 114 to the latter end of the bar 115 is set at about 30 cm so that the length of the bar is slightly shorter than nearly a half of the length of the side edge of the board.

The upper portions of the mutually adjacent L-shaped plates 117 of the mutually adjacent stanchion units are coupled to each other by a bolt 118 in such a manner that a spacer 119 made of a buffer material such as a rubber sheet is interposed between the upper portions, as shown in FIGS. 8 and 9.

Since the bars 115 are thus coupled to the lower portion of the pole 105 so as to extend in four different directions, the pole can be securely set up on the foundation 104. Since the bars 115 of the mutually adjacent stanchion units are coupled to each other with the L-shaped plates 117 at the ends of the bars, the assembly of the stanchion units has a good rigidity. The bars of all such stanchion units on the foundation can thus be coupled to each other at the mutually adjacent tips of the bars so that the strength of the assembly of the stanchion units is high enough to securely support the floor boards all over the foundation against the intense jolt. Since the L-shaped plates 117 adjacent to each other are coupled to each other with the spacer 119, a vibration transmitted from the pole 105 to the bar 115 is absorbed or reduced by the spacer.

If the bars 115 are provided nearly all over the foundation 104, the bars do not need to be secured thereto. However, if the bars 115 are likely to undergo horizontal displacement or the like, the lower portions of the L-shaped plates 117 may be secured to the foundation 104 by an adhesive to prevent the displacement or the like, or the bars may be obliquely cut at the tips thereof to expose the lower portions of the bars, and be provided with bolt holes 121 in the lower portions, as shown by dotted lines in FIG. 10, to secure the portions to the foundation by bolts to prevent the displacement or the like.

Instead of providing the L-shaped plates 117, the bars 115 may be cut off at the mutually adjacent tips thereof except the lower portions of the bars, bent upward at the portions and coupled to each other at the portions.

A stanchion unit provided in accordance with the present invention to support floor boards includes a pole, a rest secured to the pole at the upper end thereof to support the floor boards on the rest, and a plurality of bars disposed at prescribed intervals and secured at one end of each of the bars to the peripheral surface of the pole at the lower end thereof so as to extend substantially horizontally. Since the other ends of the bars are coupled to those of the bars of other such stanchion units adjacent to the former, the stanchion units can be securely set up on a foundation. Since the latter ends of the bars, at which the bending stress of the stanchion unit is zero, are coupled to those of the bars of the adjacent stanchion units, the assembly of the stanchion units is good in rigidity. L-shaped plates are provided under the bars of the mutually adjacent stanchion units at the latter ends of the bars in such a manner that the upper portions of the plates are coupled to each other to increase the area of the contact of the stanchion units to more reinforce the assembly of the units against the bending stress thereof.

Figure 11:
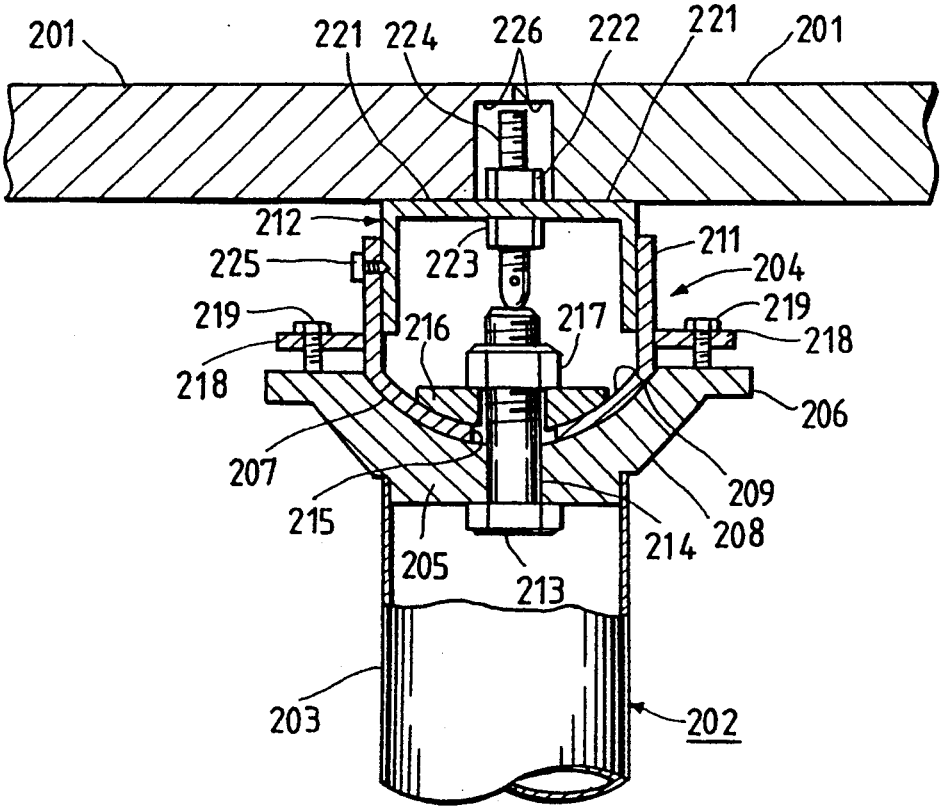
FIG. 11 is a cutaway front view of a rest assembly which is an embodiment of the present invention.
Figure 12:
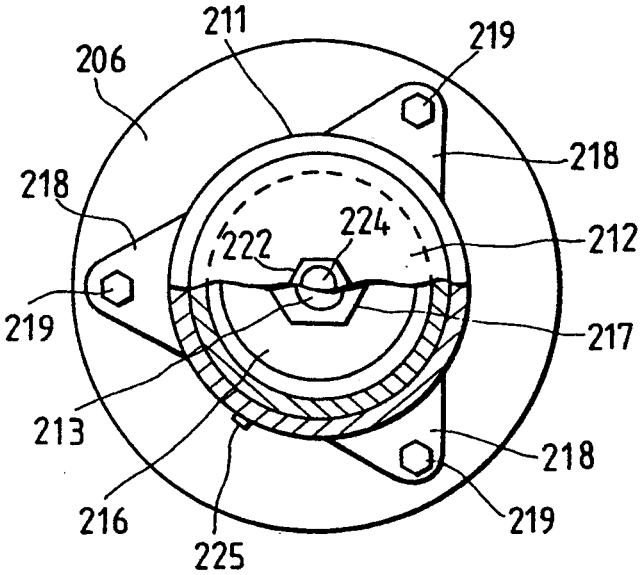
FIG. 12 is a cutaway plan view of the assembly.

FIGS. 11 and 12 show a rest assembly 204 which is the embodiment and is for a stanchion unit 202 for supporting four floor boards 201 at the corners thereof. The floor boards 201 are made of die-cast aluminum, steel, fiberglass-reinforced concrete, calcium silicate or the like. The stanchion unit 202 includes a vertical pipe 203 disposed on a base plate (not shown in the drawings) at the lower end of the pipe and set up on the plate, end the rest assembly 204 fastened to the pipe at the upper end thereof.

The rest assembly 204 includes a base 208, a lower bottomed cylinder 211, and an upper cylinder 212. The base 208 is made of die-cast aluminum, steel, hard synthetic resin or the like, and has a lower central portion 205 fitted in the vertical pipe 203 at the upper end thereof, a flange 206 located over the lower central portion and larger in outside diameter than it, and a nearly hemispherical recess 7 formed in the upper central part of the flange. The lower portion 9 of the lower cylinder 211 is shaped nearly as a hemisphere, and fitted in the recess 207. The upper cylinder 212 is fitted in the lower cylinder 211 at the upper end thereof. The cylinders 211 and 212 are made of the same material as the base 208. The base 208 has a hole 214 in the center of the base.

The rest assembly 204 also includes a bolt 213 and a screw 224. The bolt 213 is for modulating the inclination of the rest assembly 204, and extends upside down through the hole 214. An insertion hole 215, whose diameter is larger than the outside diameter of the shank of the bolt 213, is provided in the lower portion 209 of the cylinder 211 at the center thereof. A clamping nut 217 is engaged with the threaded portion 213' of the bolt 213 extending through the holes 214 and 215. A washer 216 is provided between the nut 217 and the lower cylinder 211 in such a manner that the convex bottom of the washer is in tight contact with the lower portion 209 of the cylinder.

Three juts 218 are provided at substantially equal intervals on the peripheral surface of the lower cylinder 211, and extend substantially perpendicularly to the peripheral surface. Screws 219 for fixing the inclination of the rest assembly 204 are engaged in the juts 218 in such a manner that the lower ends of the screws are in contact with the flange 206 of the base 208.

The upper cylinder 212 has a closed top portion 221, through which the screw 224 for modulating the height of the rest assembly 204 extends at the center of the closed top portion. Two nuts 202 and 223 are engaged on the screw 224, and pinch the closed top portion 221. The lower end of the screw 224 is located in contact with the upper end of the bolt 213. An anti-loosening bolt 25 is inserted into the lower cylinder 211 toward the axis thereof in the radial direction of the cylinder so that the tip of the bolt is in contact with the upper cylinder 212. Although the screw 224 projects up from the top of the upper cylinder 212, the floor boards 201 have openings 226 at the corners of the bottoms of the boards so that the screw is out of contact with the boards.

The stanchion unit 202 is set up on a floor slab not shown in the drawings. At that time, if the base plate of the stanchion unit is located on the unflat portion of the floor slab to incline the unit, the inclination can be modulated as described from now on. In the case of the inclination of the unit 202, the vertical pipe 203 is tilted, and the rest assembly 204 and the top of the upper cylinder 212 are inclined. To modulate the inclination, the bolt 225 is first loosened to remove the upper cylinder 212. The clamping nut 217 and the inclination fixing screws 219 are then loosened so that the lower cylinder 211 can be swung within the clearance between the cylinder and the inclination modulating bolt 213 in the second hole 215 about the bolt. The lower cylinder 211 is thus swung appropriately to make the open upper end thereof horizontal. When the upper end of the lower cylinder 211 is thus made horizontal, the clamping nut 217 is tightened to firmly fix the lower portion 209 of the cylinder to the recess 207 of the base 8 with the washer 16. The inclination fixing screws 219 are then driven into the juts 218 so that the lower ends of the screws are put in contact with the top of the flange 206 of the base 208 to fix the lower cylinder 211 at a prescribed angle of tilt. The lower cylinder can thus be firmly kept at the prescribed angle of tilt through the use of the three screws 219. The upper cylinder 212 is thereafter fitted in the lower cylinder 211. The anti-loosening bolt 225 is tightened to secure the upper cylinder 212 to the lower one 211.

The height of the top of the upper cylinder 212 can be modulated by slightly loosening the bolt 225 and then turning the height modulation screw 224 to move the upper cylinder up or down to equalize the height to that of the top of the upper cylinder of another stanchion unit. After the top of the upper cylinder 212 is thus set at a desired height, the bolt 225 is tightened again to fix the upper cylinder at the height.

Since not only the inclination of the stanchion unit 202 but also the height thereof can thus be modulated by the rest assembly 204 provided at the upper end of the vertical pipe 203 of the unit, it is not necessary to remove the floor boards 201 and go down to the floor slab for such modulation.

A reception part, into which the inclination modulating bolt 213 can be pushed without being turned, may be provided in the lower portion of the base 205 at the bottom thereof so that it is possible to only insert a jig into the lower cylinder 211 from the upper open end thereof and then loosen or tighten the clamping nut 217 to modulate the inclination of the stanchion unit 202.

Instead of providing the three juts 218 on the peripheral surface of the lower cylinder 211 and engaging the inclination fixing screws 219 in the juts, a flange may be provided on the peripheral surface of the cylinder and engaged with the screws at equal intervals.

A rest assembly provided for a stanchion unit for floor boards in accordance with the present invention includes a base for supporting the floor boards, and a lower cylinder which can be swung to orient the top of the assembly in an optional direction to modulate the inclination of the unit, which results from setting the unit up on the unflat portion of a floor slab. Since an upper cylinder is fitted in the lower cylinder so as to make it possible to modulate the height of the top of the upper cylinder, the height of the stanchion unit can be easily equalized to that of another stanchion unit. Since both the inclination and height of the stanchion unit can be modulated by operating only the rest assembly disposed at the upper portion of the unit, it is not necessary to remove the floor boards and go down to the floor slab for the modulation and the efficiency of the modulation is good.

What is claimed is:

1. A stanchion unit for supporting floor boards comprising:

a single rest on which said boards are supported;

an upstanding single pole fixedly secured at an upper end thereof to said rest;

a plurality of substantially horizontal bars each having one end fixedly secured at spaced apart intervals to the peripheral surface of said single pole at the lower end thereof, each of said horizontal bars having a length so that the other end thereof is spaced from its associated pole, said other end having means for coupling to a similar bar of an adjacent stanchion unit;

wherein said single rest, said single pole and said bars can be moved as a unit.

2. A stanchion unit for supporting floor boards comprising:

a rest on which said boards are supported;

an upstanding pole secured at an upper end thereof to said rest;

a plurality of substantially horizontal bars each having one end secured at spaced apart intervals to the peripheral surface of said pole at the lower end thereof, said horizontal bars having their opposite ends coupled to the bars of other stanchion units adjacent thereto;

and a plurality of L-shaped bent plates provided on the substantially horizontal bars at the ends thereof in such a manner that one portion of each of said plates is coupled to the corresponding substantially horizontal bar and to an adjacent stanchion unit.

* * * * *